US006475059B2

(12) United States Patent
Lee

(10) Patent No.: US 6,475,059 B2
(45) Date of Patent: Nov. 5, 2002

(54) SINGLE DRIVING WHEEL REMOTE CONTROL TOY VEHICLE

(76) Inventor: Jason C. Lee, 40 Nassau Pl., Princeton Jct., NJ (US) 08550

( * ) Notice: Subject to any disclaimer, the term of this patent is extended or adjusted under 35 U.S.C. 154(b) by 0 days.

(21) Appl. No.: 09/770,360

(22) Filed: Jan. 25, 2001

(65) Prior Publication Data

US 2001/0027078 A1 Oct. 4, 2001

Related U.S. Application Data

(60) Provisional application No. 60/178,663, filed on Jan. 28, 2000.

(51) Int. Cl.[7] ..... A63H 30/00

(52) U.S. Cl. ..... 446/454; 446/456; 446/469; 446/431; 446/443; 446/470

(58) Field of Search ..... 446/454, 456, 446/465, 437, 460, 462, 469, 470, 440, 443

(56) References Cited

U.S. PATENT DOCUMENTS

| | | | | | |
|---|---|---|---|---|---|
| 3,596,401 | A | * | 8/1971 | Camire | 46/213 |
| 4,197,672 | A | * | 4/1980 | Mabuchi et al. | 46/254 |
| 4,226,292 | A | * | 10/1980 | Monte et al. | 46/254 |
| 4,270,307 | A | * | 6/1981 | Arigaya | 46/254 |
| 4,406,085 | A | * | 9/1983 | Rhodes | 46/254 |
| 4,548,584 | A | * | 10/1985 | Townsend | 446/456 |
| 4,568,306 | A | | 2/1986 | Martin | |
| 4,617,002 | A | * | 10/1986 | Ishimoto et al. | 446/456 |
| 5,041,051 | A | | 8/1991 | Sonesson | |
| 5,194,032 | A | * | 3/1993 | Garfinkel | 446/431 |
| 5,334,076 | A | | 8/1994 | Shinozuka | |
| 5,429,543 | A | * | 7/1995 | Tilbor et al. | 446/456 |
| 5,533,921 | A | | 7/1996 | Wilkinson | |
| 5,643,041 | A | * | 7/1997 | Mukaida | 446/456 |
| 5,667,420 | A | | 9/1997 | Menow et al. | |
| 5,752,871 | A | | 5/1998 | Tsuzuki | |
| 5,769,441 | A | | 6/1998 | Namngani | |
| 5,820,439 | A | * | 10/1998 | Hair, III | 446/440 |
| 5,871,386 | A | * | 2/1999 | Bart et al. | 446/460 |
| 5,919,075 | A | * | 7/1999 | George et al. | 446/437 |
| 6,024,627 | A | | 2/2000 | Tilbor et al. | |
| 6,042,449 | A | | 3/2000 | Ishimoto | |

FOREIGN PATENT DOCUMENTS

| | | | | | |
|---|---|---|---|---|---|
| GB | 2357445 | A | * | 6/2001 | A63H/17/26 |

* cited by examiner

*Primary Examiner*—Derris H. Banks
*Assistant Examiner*—Urszula M Cegielnik
(74) *Attorney, Agent, or Firm*—Robert E. Howard

(57) ABSTRACT

A radio controlled toy vehicle having a single driving wheel. First and second chassis bodies are located on opposite sides of the driving wheel, and the driving wheel and chassis bodies rotatably attached to a primary axle. Support wheels are rotatably attached to the chassis bodies at a location distal to the point of attachment of the chassis bodies to the primary axle. First and second reversible electric motors are drivingly connected to the driving wheel by drive train means. A radio control receiver is attached to one of the chassis bodies, and is adapted to independently actuate the electric motors in a forward or reverse direction in response to control signals sent by a radio control transmitter. When both of the electric motors are operating in the forward or reverse direction, the driving wheel propels the vehicle in that direction. When one electric motor is operating in the forward direction and the other electric motor is operating in the reverse direction, the vehicle will cease being propelled by the driving wheel, and the first and second chassis bodies are forced to rotate in opposite directions about the primary axle, causing the vehicle to be lifted and turned.

6 Claims, 5 Drawing Sheets

SINGLE DRIVING WHEEL REMOTE CONTROL TOY VEHICLE

CROSS-REFERENCE TO RELATED APPLICATIONS

This application claims the benefit of U.S. Provisional Application No. 60/178,663, filed Jan. 28, 2000.

BACKGROUND OF THE INVENTION

This invention relates to a remote control toy vehicle having a single driving wheel.

There are many types of radio controlled toy vehicles on the market. Many of these are models of full sized vehicles. Most, if not all, have a pair of driving wheels.

SUMMARY OF THE INVENTION

It is an object of this invention to provide a radio controlled toy vehicle having a single driving wheel.

It is a further object of this invention to provide a radio controlled toy vehicle having a single driving wheel that is fully maneuverable and capable of performing lifting turns.

These and other objects are obtained by providing a radio controlled toy vehicle having a single driving wheel that is drivingly coupled to first and second reversible electric motors. By "reversible" electric motor is meant an electric motor whose drive shaft can be turned either clockwise or counterclockwise. The first and second reversible electric motors are attached to first and second chassis bodies, respectively, the chassis bodies being located on opposite sides of the driving wheel. The driving wheel is rotatably mounted on a primary axle (beam), and the chassis bodies are rotatably attached to the same primary axle at their pivot points.

Distal to the pivot points of the chassis bodies are first and second support wheels that are rotatably attached to a lower outer portion of said first and second chassis bodies, respectively. The support wheels guide the vehicle in a straight line during forward or reverse motion and allow for smooth action during lifting and turning movements.

The distance between the pivot points of the chassis bodies and the distal bottom of the support wheels is greater than the radius of the driving wheel; this provides mechanical advantage to the driving wheel and for lifting and turning of the vehicle. Stated another way, the distance between the axis of the primary axle and the axis of the axle upon which either of the support wheels is rotatably mounted plus the radius of that support wheel is greater than the radius of the driving wheel.

The vehicle is steered by controlling the operation and direction of each motor. The vehicle is capable of moving forward, reverse, turning left and right. When one motor direction is the reverse of the other, the vehicle will cease being propelled by the driving wheel, and the individual chassis bodies will swing around their pivot points in opposite directions. The simultaneous and opposing actions of the chassis bodies lifts and turns the vehicle.

Chassis body extensions are provided to increase the effective width of the vehicle beyond that of the width of the driving wheel by itself so that the vehicle width is greater than the diameter of the driving wheel, thereby causing the driving wheel to preferentially stay in contact with the surface over which the vehicle is being driven.

Since the vehicle is comprised mainly of a single driving wheel it is able to freely roll over or bounce off obstacles without the likelihood of becoming disabled.

DESCRIPTION OF PREFERRED EMBODIMENTS

Figure 1:
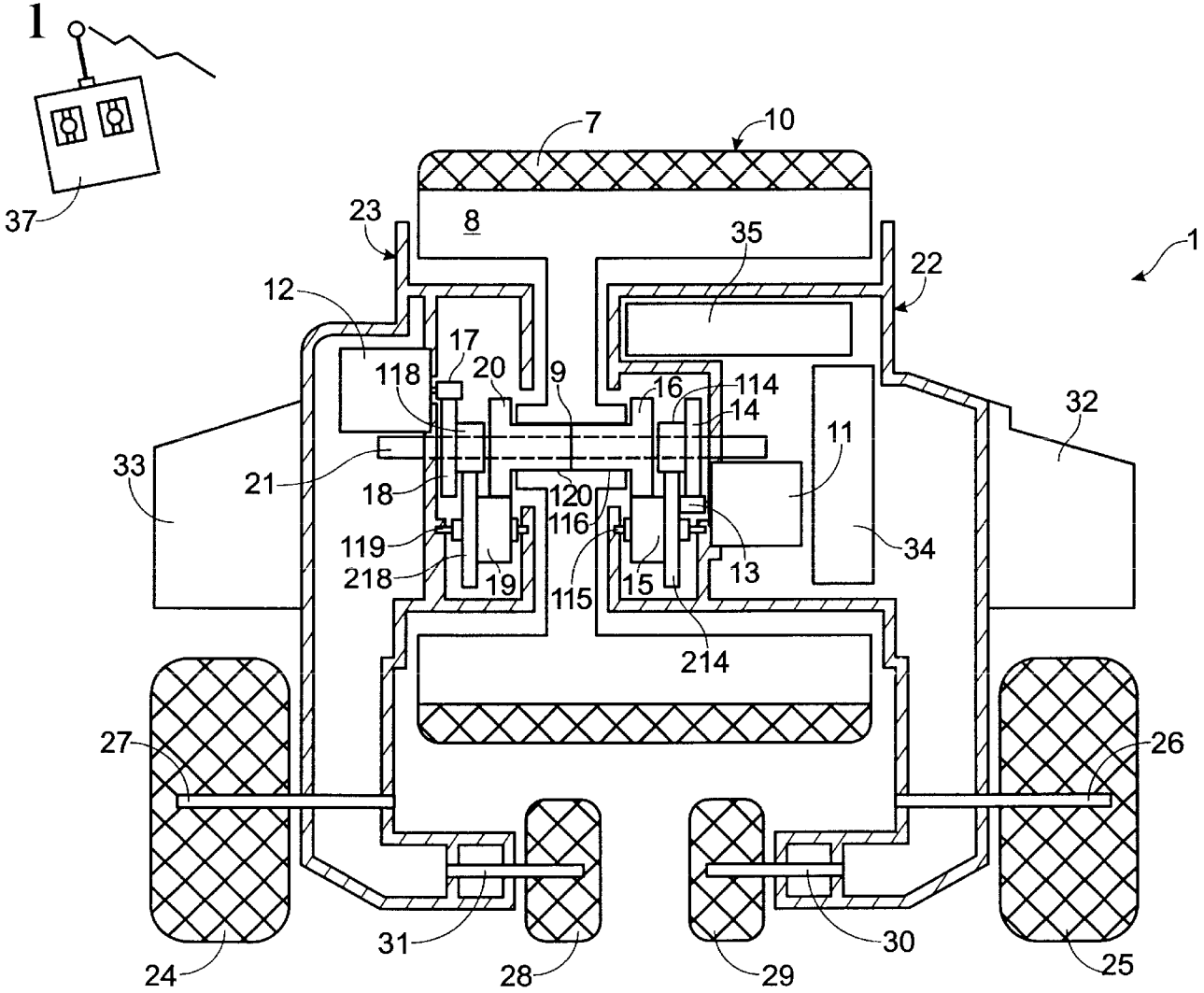
FIG. 1 is a rear view, partially in cross-section, of the vehicle of the present invention, with the driving wheel in the raised position shown in FIG. 9.
Figure 2:
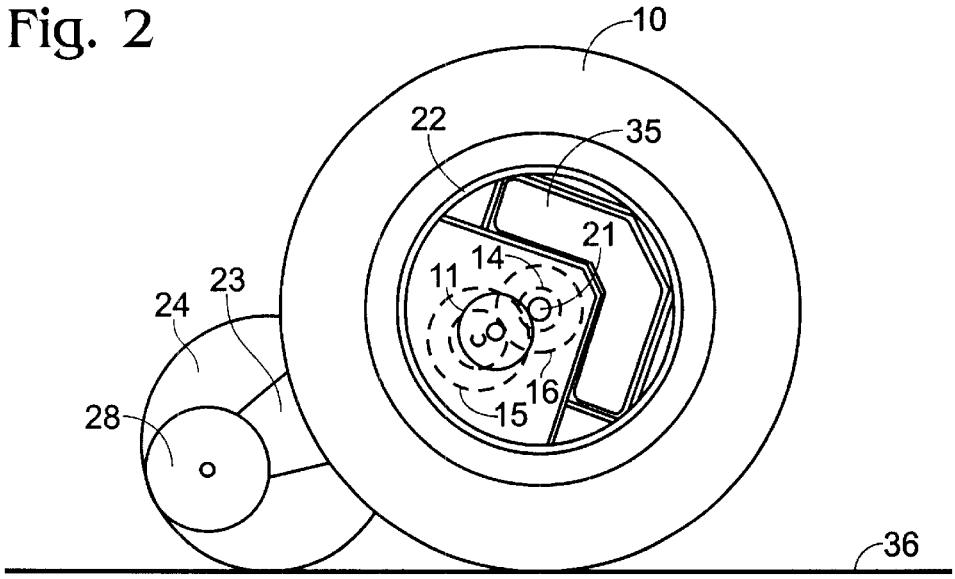
FIG. 2 is a right side view, partially in cross-section, taken along line 2—2 of FIG. 5.

In the drawings, the reference numbers and the parts to which they refer are as follows.

1: toy vehicle of the present invention
7: tire
8: tire rim
9: tire rim hub
10: driving wheel
11: electric motor
12: electric motor
13: pinion gear
14: spur gear
15: spur gear
16: spur gear
17: pinion gear
18: spur gear
19: spur gear
20: spur gear
21: primary axle or beam
22: right chassis body
23: left chassis body
24: left support wheel
25: right support wheel
26: right support wheel stub axle or beam
27: left support wheel stub axle or beam
28: left auxiliary support wheel
29: right auxiliary support wheel
30: right auxiliary support wheel stub axle or beam
31: left auxiliary support wheel stub axle or beam
32: right chassis body extension
33: left chassis body extension
34: two channel radio control receiver
35: battery compartment
36: driving surface
37: two channel radio control transmitter
114: spur gear
115: coaxial gear axle
116: driving wheel axle extension
118: spur gear

119: coaxial gear axle
120: driving wheel axle extension
214: spur gear
218: spur gear The toy vehicle 1 of the present invention has a single driving wheel 10 that includes a rubber or similar tire 7 positioned on a rim 8 having a hub 9.

Driving wheel 10 is relatively wide, having a width of at least about 50% of its diameter, and preferably at least about 70% of its diameter.

Right and left chassis bodies 22 and 23 each have an upper end that fits inside rim 8, as best seen in FIG. 1.

Herein, whenever "right" and "left" are used to describe an element of the invention, it is intended that the right and left sides are determined relative to a rear (FIG. 1) view of the toy vehicle 1. Similarly, whenever "upper" or "lower" is used, upper or lower is determined relative to the position of the toy vehicle 1 shown in its normal upright position shown in the drawings, with the driving surface 36 being "down". "Inwardly" and "outwardly" are in the direction toward the interior or exterior of toy vehicle 1, respectively.

A primary axle 21 extends between right and left chassis bodies 22 and 23, and chassis bodies 22 and 23 are rotatably attached thereto.

Reversible right and left electric motors 11 and 12 are attached to right and left chassis bodies 22 and 23, respectively, as shown.

Primary axle 21 serves as a conduit for power or control signals. For example, primary axle 21 can be hollow and power and control wiring between receiver 34 and left electric motor 12 can extend through primary axle 21. Alternatively, primary axle 21 may be electrically conductive and in communication with rotary commutators.

Access to the battery or batteries located in battery compartment 35 can be obtained by a suitable hatch (not shown) on the outer face of right chassis body 22. The battery circuit may include a suitable on/off switch (not shown), such switch preferably being located on the outside of right chassis 22 for easy access.

The drive shaft of right electric motor 11 has a pinion gear 13 located on the outer end thereof. The right drive train gearing includes pinion gear 13, externally contacting spur gear 14, internally contacting spur gear 114, externally contacting spur gear 214, internally contacting spur gear 15, and externally contacting spur gear 16. Gears 14, 114 and 16 are rotatably attached to axle 21. Coaxial gears 214 and 15 are rotatably attached to right chassis body 22 by coaxial gear axle 115.

Similarly, the drive shaft of left electric motor 12 has a pinion gear 17 located on the outer end thereof. The left drive train gearing includes pinion gear 17, externally contacting spur gear 18, internally contacting spur gear 118, externally contacting spur gear 218, internally contacting spur gear 19, and externally contacting spur gear 20. Gears 18, 118 and 20 are rotatably attached to axle 21. Coaxial gears 218 and 19 are rotatably attached to left chassis body 23 by coaxial gear axle 119.

Gears 16 and 20 have hollow splined shaft extensions 116 and 120, respectively. Hub 9 of driving wheel 10 is attached to spline shaft extensions 116 and 120 by splines (not shown). Primary axle 21 passes through hollow splined shaft extensions 116 and 120, as shown.

A right support wheel stub axle 26 extends outwardly from the lower portion of right chassis body 22, and right support wheel 25 is rotatably mounted thereon.

Similarly, a left support wheel stub axle 27 extends outwardly from the lower portion of left chassis body 23, and left support wheel 24 is rotatably mounted thereon.

Figure 6:
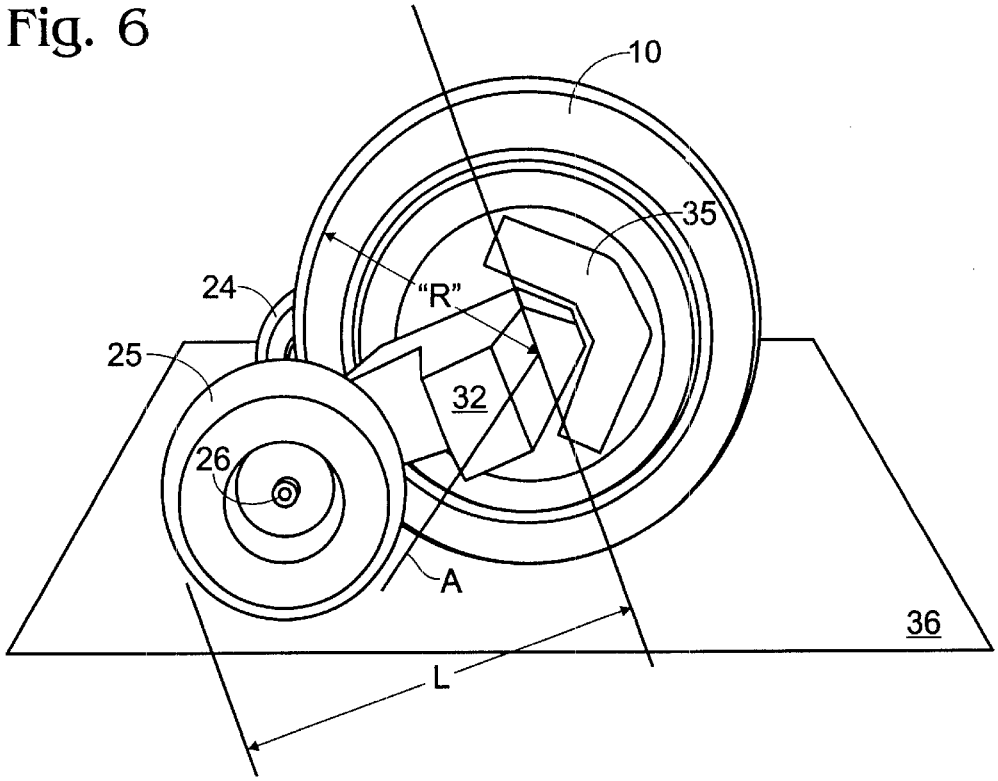
FIG. 6 is a right side perspective view of the vehicle of the present invention.

As seen in FIG. 6, the radius "R" of wheel 10 is less than the distance "L" between the axis of primary axle 21 and the distal bottom of support wheel 25, the distance between the axis of primary axle 21 and the distal bottom of support wheel 24 also being equal to "L". Stated another way, the radius "R" of wheel 10 is less than the distance "L" between the axis of primary axle 21 and the axis of axle 26 or 27 plus the radius of support wheel 24 or 25, respectively.

A right auxiliary wheel stub axle 30 extends inwardly from a lower portion of right chassis body 22, below the level of right support wheel stub axle 26, and right auxiliary support wheel 29 is rotatably mounted thereon.

A left auxiliary wheel stub axle 31 extends inwardly from a lower portion of left chassis body 23, below the level of left support wheel stub axle 27, and left auxiliary support wheel 28 is rotatably mounted thereon.

Right and left chassis body extension members 32 and 33 are attached to the upper outer walls of right and left chassis bodies 22 and 23, respectively. Chassis body extensions are provided to increase the effective width of the vehicle beyond that of the width of the driving wheel by itself so that the vehicle width is greater than the diameter of the driving wheel, thereby causing the driving wheel to preferentially stay in contact with the surface 36 over which the vehicle is being driven.

A two channel radio control receiver 34 is attached to right chassis body 22, as shown. A suitable antenna (not shown) is attached to receiver 34 in a manner well known in the art. Suitable control wiring and circuitry well known in the art (not shown) communicates receiver 34 with electric motors 11 and 12, and the electric power source (battery) located in battery compartment 35. Such control wiring is adapted to provide power and control signals to motors 11 and 12 in a manner adapted to cause motors 11 and 12 to operate in either a forward or reverse direction. Radio receiver 34 is a two channel receiver of the type readily available in hobby shops.

A two channel radio transmitter 37 is used to send commands to receiver 34. Transmitter 37 is a two channel transmitter of the type readily available in hobby shops.

An example of a suitable transmitter/receiver is a 2ER model marketed by Futaba of America.

In operation, toy vehicle 1 is placed on a suitable driving surface 36, vehicle 1 having the configuration shown in FIGS. 4–7. Radio control signals are sent by transmitter 37 to receiver 34 to cause electric motors 11 and 12 to operate in the same forward or reverse direction, and wheel 10 is, accordingly, driven in that direction.

If it is desired to execute a turn, one motor is commanded to operate in either the forward or reverse direction, and the other motor commanded to operate in the opposite direction. This causes wheel 10 to cease propelling the toy vehicle 1 in the forward or reverse direction, but since the motors are still causing the drive train to operate, the chassis bodies 22 and 23 will be forced to rotate about primary axle 21 in opposite directions. This causes the vehicle to lift and turn.

Figure 7:
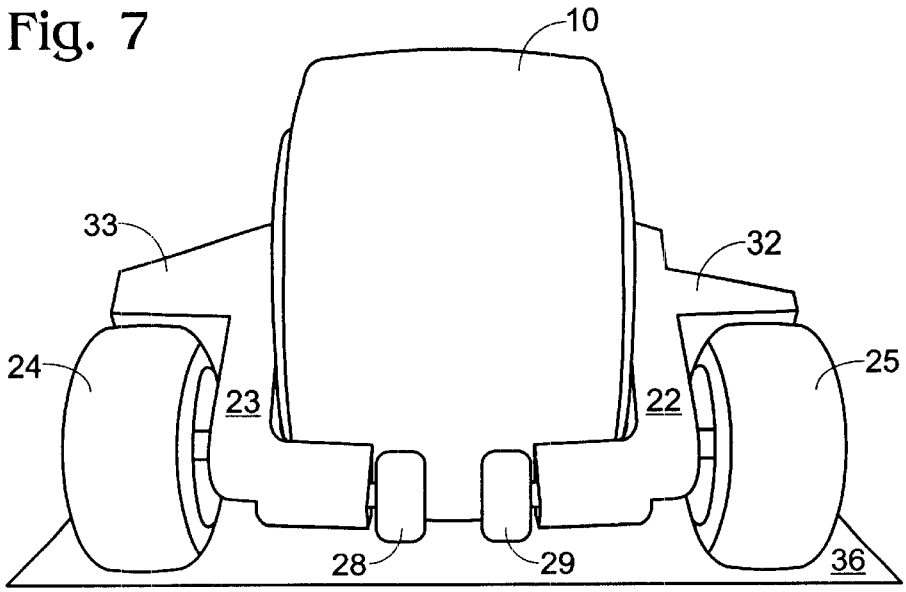
FIG. 7 is a full rear perspective view of the vehicle of the present invention.

This lifting and turning maneuver is best understood by reference to FIGS. 3 and 6 to 9. In FIGS. 6 and 7 toy vehicle 1 is shown with right and left chassis bodies 22 and 23, and associated right and left support wheels 25 and 24, in the position they would occupy when the vehicle was being propelled in a forward direction. Upon instructing left reversible electric motor 12 to operate in the reverse direction, driving wheel 10 ceases to propel vehicle 1. When this happens, left chassis body 23 and associated left support wheel 24 are caused to rotate clockwise around primary axle 21 through which axis A runs to the position shown in FIG.

8. As left chassis body 23 and associated left support wheel 24 rotates forward, left support wheel 24 lifts the left side of vehicle 1 upwardly, causing vehicle 1 to turn to the right.

Figure 3:
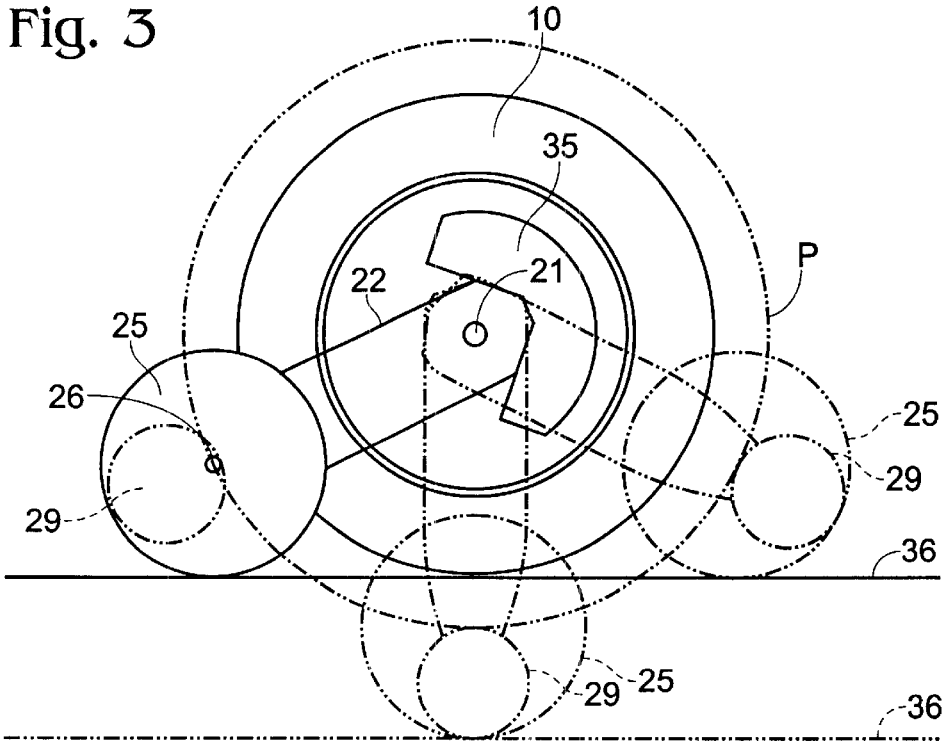
FIG. 3 is a right side view of the vehicle of the present invention, showing the rotational path of the right chassis body and right support wheel.
Figure 4:
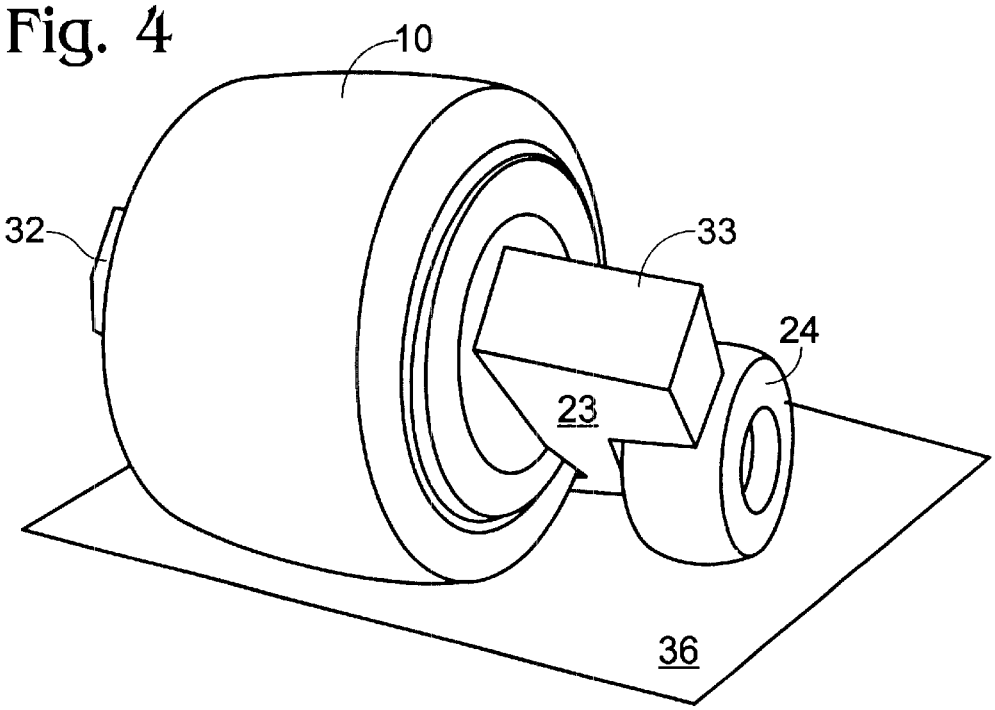
FIG. 4 is a left front perspective view of the vehicle of the present invention.
Figure 5:
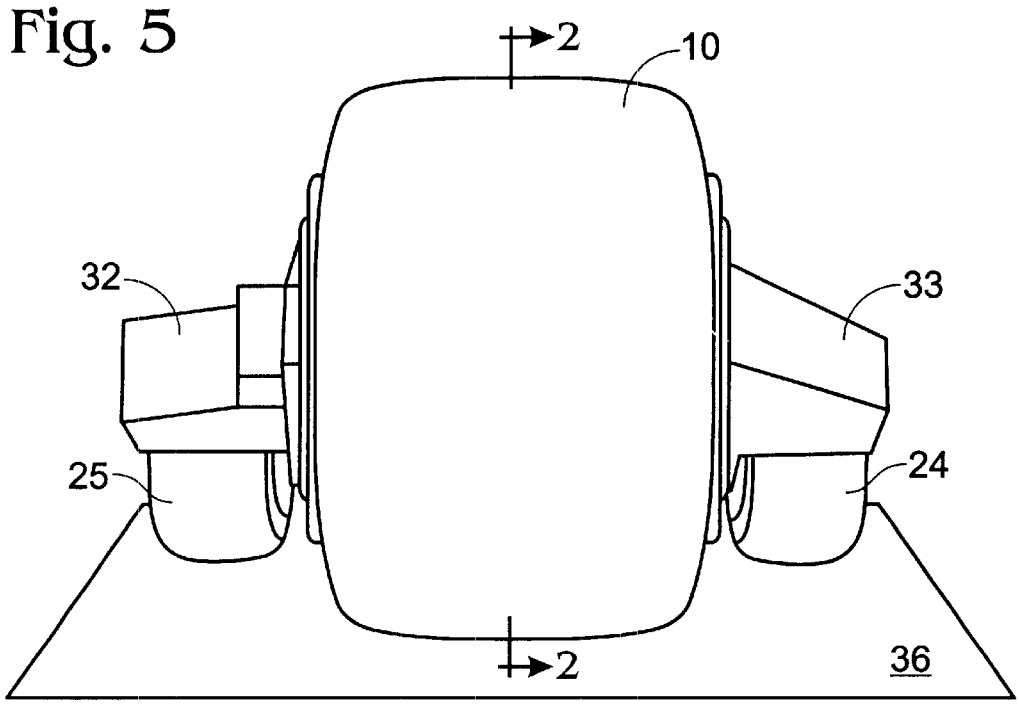
FIG. 5 is a full front perspective view of the vehicle of the present invention.
Figure 8:
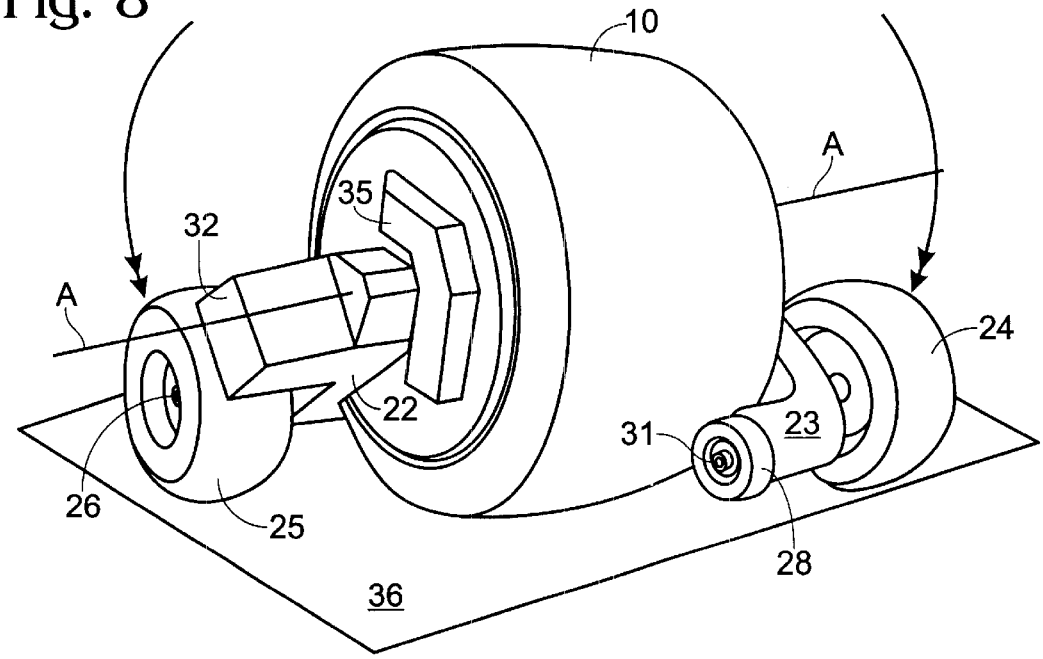
FIG. 8 is a right front perspective view of the vehicle of the present invention, showing the chassis bodies rotating in opposite directions just prior to lifting and/or turning of the vehicle.

Upon reversing the electric motors 11 and 12 again, left chassis body 23 and associated left support wheel 24 are caused to rotate counterclockwise around primary axle 21 (in the direction of the associated arrow in FIG. 8), and right chassis body 22 and associated right support wheel 25 are caused to rotate in the opposite direction (i.e., in the direction of the associated arrow in FIG. 8). The counterclockwise rotation of right chassis body 22 and associated right support wheel 25 from the rear to the front of vehicle 1 is shown in FIG. 3, where the path of right support wheel stub axle 26 is shown in phantom and designated as "P".

Figure 9:
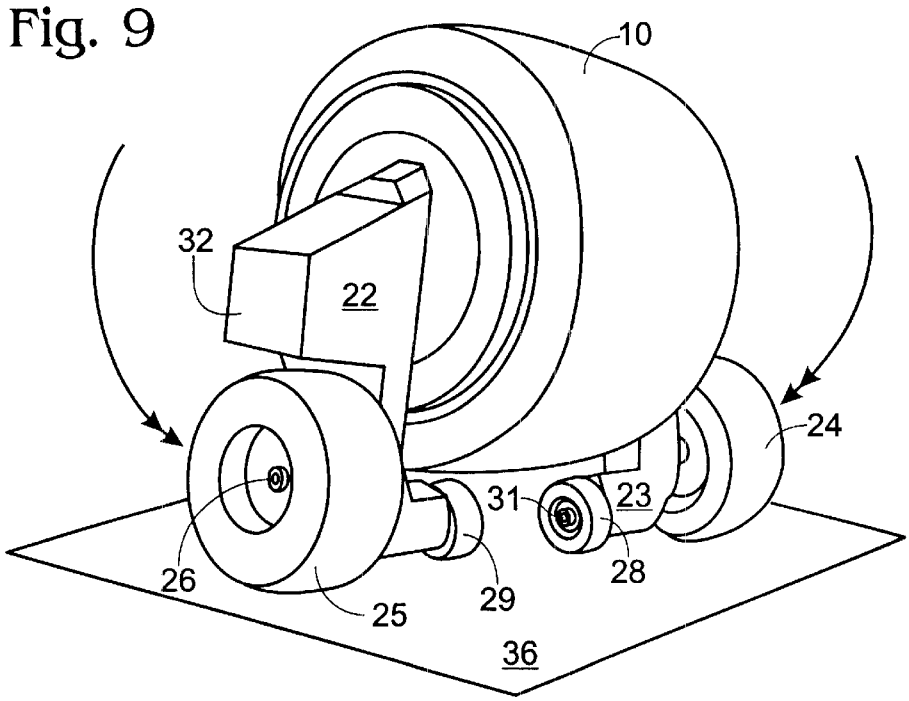
FIG. 9 is a right front perspective view of the vehicle of the present invention, showing the chassis bodies lifting up and/or turning the vehicle.

When both left and right support wheels 24 and 25 are at the mid-point of their rotation, as seen in FIG. 9, driving wheel 10 is completely lifted from driving surface 36.

Upon completion of the lifting and turning maneuver, electric motors 11 and 12 are then commanded to operate in the same direction (i.e., either forward or reverse), and driving wheel 10 commences to propel toy vehicle 1 in the forward or reverse direction selected.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A radio controlled toy vehicle comprising:

first and second chassis bodies;

a horizontal primary axle extending between upper portions of said first and second chassis bodies and rotatably attached thereto;

a driving wheel intermediate said first and second chassis bodies, said driving wheel being rotatably attached to said primary axle;

a first reversible electric motor having a drive shaft attached to said first chassis body and a second reversible electric motor having a drive shaft attached to said second chassis body;

a first drive train means coupling said drive shaft of said first reversible electric motor to said primary axle of said driving wheel, and a second drive train means coupling said drive shaft of said second reversible electric motor to said primary axle of said driving wheel;

an electric power source adapted to supply electric current to said first and second reversible electric motors;

first and second axles extending from a lower portion of said first and second chassis bodies, respectively;

first and second support wheels rotatably attached to said first and second axles, respectively; and a radio control receiver attached to one of said chassis bodies, said receiver adapted to independently actuate said first and second reversible electric motors in a forward or reverse direction in response to control signals sent by a radio control transmitter.

2. The vehicle of claim 1 additionally including first and second auxiliary support wheels rotatably attached to lower portions of said first and second chassis bodies, respectively, said first and second auxiliary support wheels being on the side of said first and second chassis bodies opposite the side on which said first and second support wheels are located.

3. The vehicle of claim 1 additionally including first and second chassis body extensions extending from upper outer portions of said first and second chassis bodies, respectively.

4. The vehicle of claim 1 wherein said driving wheel has a width that is greater than about 50% of said driving wheel's diameter.

5. The vehicle of claim 4 wherein said width is greater than about 70% of said diameter.

6. The vehicle of claim 1 wherein the distance between the axis of said primary axle and the distal bottom of either said first or second support wheel is greater than the radius of said driving wheel.

* * * * *